United States Patent [19]

Konz

[11] Patent Number: 4,470,768

[45] Date of Patent: Sep. 11, 1984

[54] ROTARY VANE PUMP, IN PARTICULAR FOR ASSISTED STEERING

[75] Inventor: Erwin Konz, Friedrichsdorf, Fed. Rep. of Germany

[73] Assignee: Sperry Vickers Zweigniederlassung der Sperry GmbH, Bad Homburg, Fed. Rep. of Germany

[21] Appl. No.: 455,267

[22] Filed: Jan. 3, 1983

[51] Int. Cl.[3] ..... F04B 49/02

[52] U.S. Cl. ..... 417/310; 418/133

[58] Field of Search ..... 417/310, 300; 418/133

[56] References Cited

U.S. PATENT DOCUMENTS 2,746,392 5/1956 Klessig et al. ..... 417/310 X 2,800,083 7/1957 Tweedale ..... 417/310

2,880,674 4/1959 Klessig et al. ..... 417/310 X 4,347,047 8/1982 Shiozawa et al. ..... 417/310

4,347,048 8/1982 Kawabata et al. ..... 417/310

*Primary Examiner*—Richard E. Gluck

*Attorney, Agent, or Firm*—Barnes, Kisselle, Raisch, Choate, Whittemore & Hulbert

[57] ABSTRACT

A rotary vane pump, in particular for steering assistance, comprising a rotor (7), a cam ring (5) and a pressure plate (4). The housing (1) has two parallel bores (17*a,* 17*b*) and cast passages (18*a,* 18*b*) as feed passages which each split up into two flow paths (23, 24) in the region of the pressure plate (4) and the cam ring (5). The outlet passages (31, 32, 33) are of a similar configuration.

5 Claims, 5 Drawing Figures

ROTARY VANE PUMP, IN PARTICULAR FOR ASSISTED STEERING

In a rotary vane pump of that kind described in U.S. Pat. No. 2,880,674, a housing structure of extensive dimensions has been required, in comparison with the size of the rotor, in order to take the hydraulic fluid to the two inlet ports of the working areas. The two inlet ports of each working area are supplied with fluid in different ways, as a result of the inertia of flowing fluid. The elbow-bent portions of the feed passages are produced by intersecting bores, and that results in increased losses due to the change in the direction of flow of the fluid, and the flow conditions are not entirely symmetrical. All that detrimentally affects uniform filling of the two working areas with fluid.

In U.S. Pat. No. 2,800,083 a rotary vane pump having a feed passage from the oil storage chamber to branching feed passages which at their ends communicate with reniform inlet ports in which the flow of fluid is divided in such a way that a component flow passes through a cam ring passage and a blind bore in the pressure plate to the side of the rotor which is remote from the reniform inlet ports, and can contribute to filling the respective working area with fluid. The disadvantage with the known construction is the non-symmetrical feed of hydraulic fluid to the two reniform inlet ports, one of which is favoured by the inertia of the inlet flow, while the other is put at a disadvantage. The result of this is that the speed of rotation of the pump cannot be very high, in order to avoid the danger of cavitation and the excessive production of noise.

In the case of commercially available steering assistance pumps which are being built at the present time, the feed passages favour one working area and leave the other working area in the flow shadow so that, in the event of an increase in the speed of revolution, there is the danger of cavitation and excessive noise.

The invention solves the problem of providing a rotary vane pump of the kind set forth above, wherein the two working areas are even more uniformly filled with fluid, and of compacter type.

The problem set is solved by the features recited in claim 1. Further developments are set forth in the subsidiary claims.

A steering assistance pump constructed in accordance with the present invention, for pressures in the range of from 65 to 82 bars, was of an overall weight which was 400 to 450 g less than the weight of a commercially available steering assistance pump having the same output. By virtue of the working chambers being uniformly filled, and by better screening of the noise-generating components, it was possible for the noise generated to be clearly reduced and the maximum speed of rotation to be increased.

An embodiment of the invention is described with reference to the drawing in which.

Figure 1:
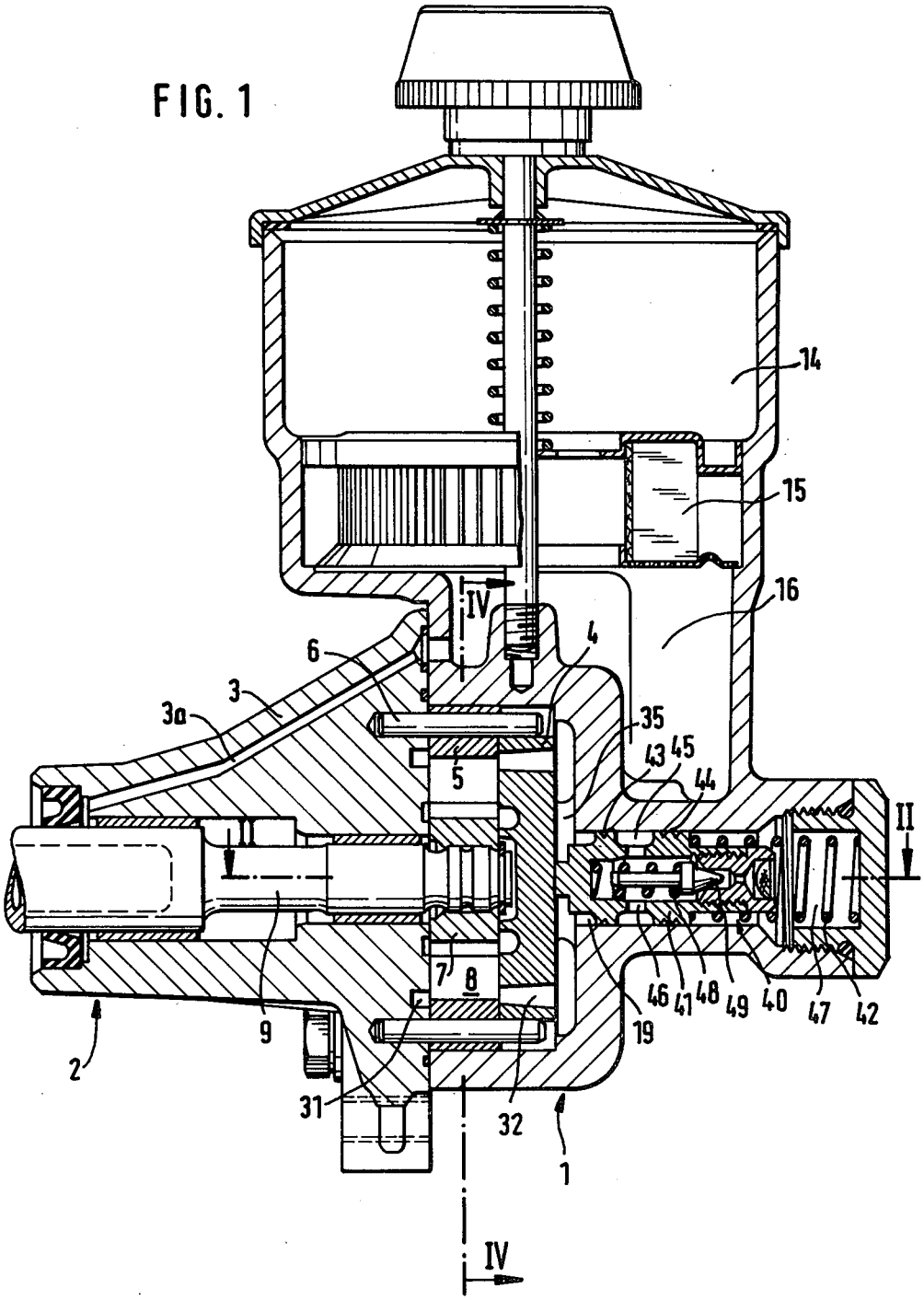
FIG. 1 shows a view in longitudinal section through a steering assistance pump.

The rotary vane pump comprises a main housing portion 1 and a housing cover 2, which fluid-tightly enclose an internal cavity or chamber 1*a*. Disposed in the chamber 1*a* and fixed with respect to the housing are a pressure plate 4 and a cam ring 5 which are secured against rotary movement by pins 6. Disposed within the ring 5 and between the cover 2 and the pressure plate 4 is a rotor 7 which has a series of radial guide slots. Blades or vanes 8 are radially displaceably mounted within the guide slots. The rotor 7 can be driven by means of a shaft 9 which is mounted in a mounting bore in the cover 2. The rotor 7 is of a cylindrical shape, while the ring 5 has an approximately oval internal configuration, the short axis of which approximately corresponds to the diameter of the rotor 7, while the large axis determines the length of extension movement of the vanes 8. In this way, two sickle-shaped working areas 11 and 12 are formed between the ring 5 and the rotor 7, the working areas 11 and 12 being divided by the vanes 8 into a number of cell chambers. The cell chambers increase in size on the suction side of the system, while they decrease in size on the pressure side.

Figure 2:
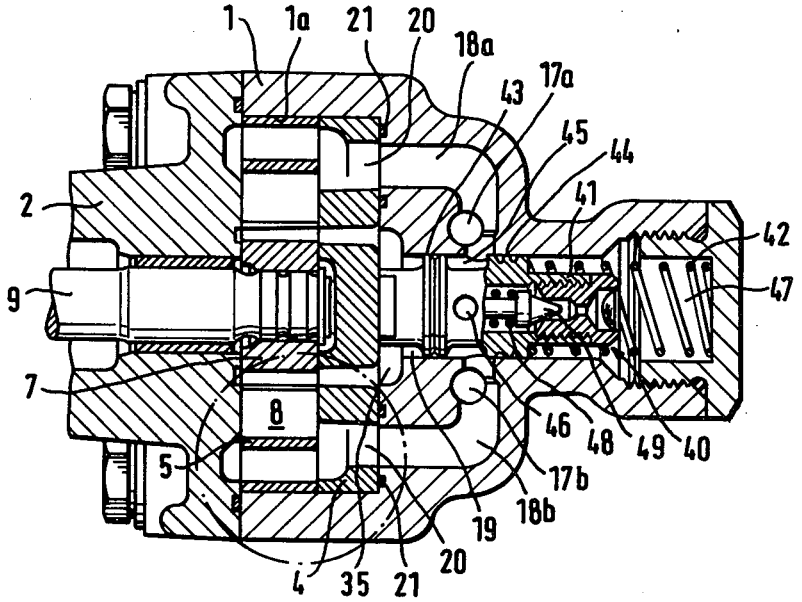
FIG. 2 shows a view in section taken along line II—II in FIG. 1.
Figure 4:
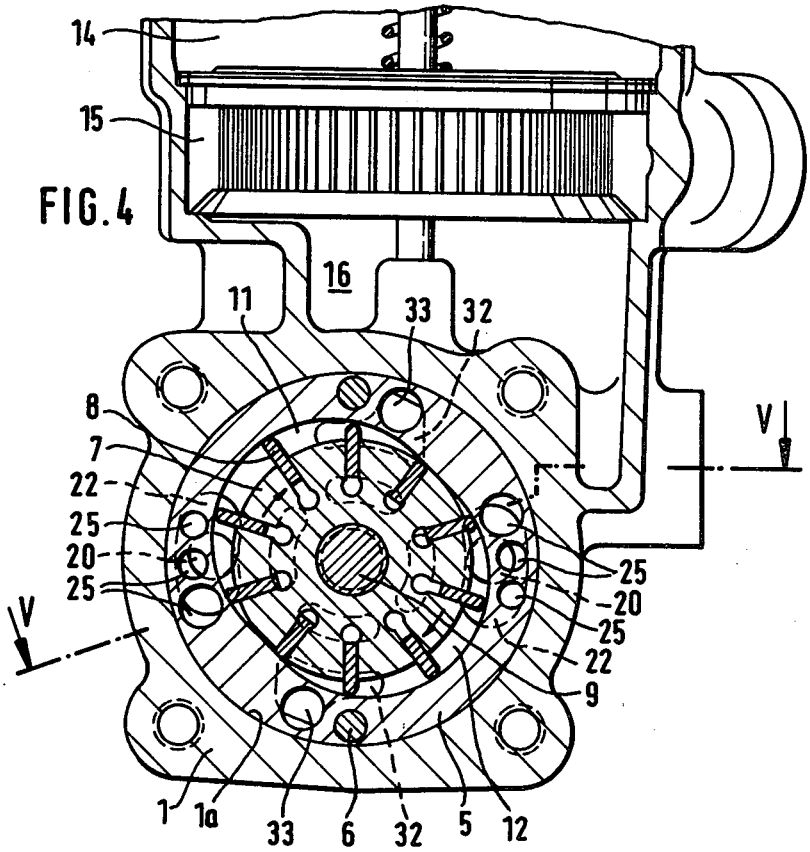
FIG. 4 shows a view in section taken along line IV—IV in FIG. 1.
Figure 5:
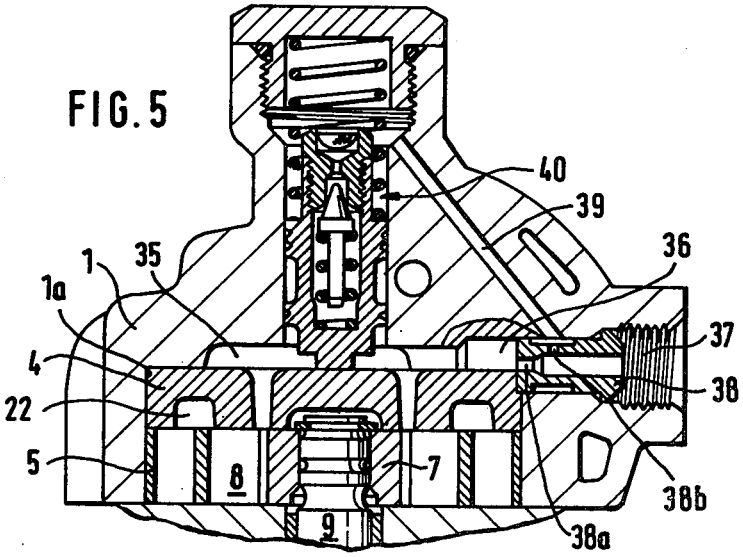
FIG. 5 shows a view in section taken along line V—V in FIG. 4.

The feed of hydraulic fluid to the respective suction side of the system is as follows: return hydraulic fluid is passed under a storage container 14 into a filter chamber 15 from which the fluid passes into an oil storage chamber 16 which is disposed in a semicircular configuration around the cam ring 5, the rotor 7, the pressure plate 4 and the housing support walls thereof. Two feed passages 17*a*, 18*a* and 17*b*, 18*b* each include a perpendicular section, formed by bores 17*a* and 17*b* respectively, and a horizontal elbow-bent section 18*a* and 18*b* respectively. The elbow-bent sections 18*a* and 18*b* of the feed passages are disposed substantially in the horizontal plane passing through the axis of the pump (see FIG. 2) and are arranged symmetrically relative to each other. The radial limb portions of the sections 18*a* and 18*b* of the feed passages communicate with a valve chamber 19 which is aligned with respect to the shaft 9 while the axial limb portions of the feed passage sections each communicate with through apertures 20 in the pressure plate 4. Peripheral seals 21 seal the gap between the rear face of the pressure plate 4 and the housing wall 1. The apertures 20 are increased in width towards the front face of the pressure plate 4 and form a bent elongate flow division chamber 22 which extends in the peripheral direction and in which a flow division effect takes place. A radially inward flow 23 passes through the radially inward portion of the aperture 20 and the flow division chamber 22 directly by way of a first inlet 27 into the working area 11 or 12 between the ring 5 and the rotor 7, while a radially outward flow 24 flows through the radially outward portion of the aperture 20 and the flow division chamber 22. Three bores 25 in the cam ring 5 form a cam ring passage which extends in the axial direction and which leads to a groove 26 in the housing, the groove 26 deflecting the flow 24 radially inwardly. The groove 26 is enlarged in the peripheral direction at its radially inward end, and there forms a second inlet 28 into the working area of the pump. Arcuate grooves 31 and 32 are provided on both sides of the vanes 8, in the cover 2 and in the pressure plate 4 respectively. The grooves 31 communicate with the grooves 32 (see FIG. 1) by way of respective bores 33 (see FIG. 4) through the ring 5. The grooves 32 each include a bore through the pressure plate 4. A pressure chamber 35 is formed at the rear of the pressure plate 4 and causes the pressure plate 4 to be properly applied against the rotor 7 and the cam ring 5, and communicates with an external pump outlet 37 by way of a delivery passage 36. Disposed in the duct 36 is a throttle member 38 having a delivery throttle 38*a* and an auxiliary throttle 38*b*. The auxiliary throttle 38*b* is connected to a flow control valve 40 by way of a passage 39. The flow control valve 40 has a spool 41 which is urged towards the rear face of the pressure plate 4 by the force of a spring 42. The spool has two sealing land regions 43 and 44 between which is defined an annular groove 45 into which the feed passages 17*a*, 18*a* and 17*b*, 18*b* respectively normally open. From the annular groove 45, a passage 46 which extends partly radially and partly axially passes through the spool 41 into a valve chamber 47 with which the passage 39 communicates and in which the spring 42 is disposed. A spring 48 and a valve cone portion 49 are arranged within the passage 46.

Figure 3:
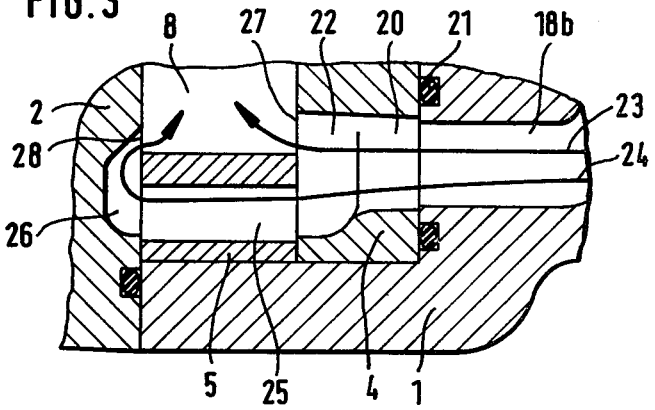
FIG. 3 shows a detail from FIG. 2, on an enlarged scale.

Operation of the steering assistance pump is as follows:

The drive to the shaft 9 causes the rotor 7 to rotate, and thus causes the vanes 8 to move through the sickle-shaped working areas 11, 12. Hydraulic fluid is sucked in, and can enter at both sides of the vanes 8, as indicated by the flows 23 and 24 in FIG. 3. The fluid feed takes place in the same manner in respect of both working areas 11, 12, by way of the substantially symmetrical feed passages 17*a*, 18*a* and 17*b*, 18*b* respectively. This 'parallel feed' configuration provides for uniform distribution of the filling pressure to both working areas 11, 12. That has the effect of reducing noise, as a result of eliminating cavitation. The hydraulic fluid which is sucked into the pump is displaced into the pressure region by the vanes 8, and, by way of the outlet passages 31, 32, flows into the pressure chamber 35 and from there to the external pump outlet 37, by way of the delivery passage 36 and the throttle member 38. If more hydraulic fluid than the main throttle 38*a* permits is delivered, then the pressure in the pressure chamber 35 rises and the spool 41 is displaced against the force of the spring 42 until the sealing land surface 43 moves partly to a position beyond the mouth opening of the feed passages 17*a*, 18*a*, 17*b*, 18*b*. That flow control action provides a direct communication between the pressure chamber 35 and the feed passages, which is extremely short, so that the hydraulic fluid flow which is controlled down is turned with a low level of energy loss.

If, with a blocked working duct, the pressure in the pump outlet rises, the valve cone portion 49 lifts off so that the pressure in the valve chamber 47 drops and the spool 41 is moved towards the right in the drawing. That restores the direct communication between the pressure chamber 35 and the feed passages 17*a*, 18*a*, 17*b*, 18*b* (function as a pressure limiting or relief valve).

Due to the pressure chamber 35 being arranged centrally in the housing 1, the surrounding wall portions have a good sound-barrier effect, particularly because in addition the flow control valve 40 is also disposed in alignment with the axis of the rotor 7 and the pressure plate 4.

The housing cover 2 comprises aluminium, on the one hand to save weight and on the other hand to provide a good bearing surface. Use is made of a reinforcing rib 3 to accommodate a leakage oil bore 3*a* which returns to the chamber 16, any leakage oil which creeps along the shaft 9. The existence of the storage chamber 16 means that the size of the storage container 14 can be correspondingly reduced, thereby achieving a further saving in the size and weight of the overall pump construction.

I claim:

1. A rotary vane pump comprising a housing having an internal cavity and a cam ring fixed therein, a pressure plate in said internal cavity and being backed by a pressure space, a rotor having vanes and being disposed in said cavity between said cam ring and said pressure plate, said cam ring together with said rotor defining two pumping regions being divided into cell chambers by said vanes, oil storage means arranged above said housing, a shaft being drivingly connected to said rotor and journalled in said housing, said shaft defining an axial direction, inlet passage means in said housing, pressure plate and cam ring and including first and second inlet passages and a first and a second inlet ports for each pumping region, said first and second inlet passages extend from said oil storage means to said first and second inlet ports of each said pumping regions, said first and second inlet passages each including a normally vertical passage section, a normally horizontal elbow-bend passage section and a flow division chamber, each said elbow-bend section comprising a radial limb portion and an axial limb portion, each said flow division chamber being arranged in said pressure plate registered to said axial limb portion of said elbow-bend section of said inlet passage, and forming a radially inner flow space which is directly connected to said first inlet port of each pumping region, and a radially outer flow space which is connected through said passage in said cam ring and said housing to said second inlet port, outlet means comprised in said housing, in said cam ring and in said pressure plate and including first and second outlet passages, said pressure space and supply passages, each said first and second outlet passage extends from one of said pumping regions to said pressure space and said supply passages, a valve means in said internal cavity, said valve means being arranged to valve fluid between said pressure space and said radial limb portions of said elbow-bend sections of said first and second inlet passages.

2. A rotary vane pump according to claim 1 wherein each flow division chamber neighbouring to said passage in said cam ring has a circumferentially extending portion, and neighbouring to said axial limb portion of said inlet passage, has an axially extending portion.

3. A rotary vane pump according to claim 2 wherein each said cam ring passage is formed by parallel bores which extend in said axial direction through said cam ring.

4. A rotary valve pump according to claim 1 wherein said radial limb portion and said axial limb portion of said elbow-bend passage sections are connected by a smooth transition.

5. A rotary vane pump according to claim 1 wherein first and second outlet ports of a single pumping region are connected together by way of a passage in the cam ring, said first outlet port being formed as a flow combining chamber.

* * * * *